US008075252B2

(12) United States Patent
Xu

(10) Patent No.: US 8,075,252 B2
(45) Date of Patent: Dec. 13, 2011

(54) COOLING FAN

(75) Inventor: Hong-Bo Xu, Shenzhen (CN)

(73) Assignees: Hong Fu Jin Precision Industry (ShenZhen) Co., Ltd., Shenzhen, Guangdong Province (CN); Hon Hai Precision Industry Co., Ltd., Tu-Cheng, New Taipei (TW)

( * ) Notice: Subject to any disclaimer, the term of this patent is extended or adjusted under 35 U.S.C. 154(b) by 479 days.

(21) Appl. No.: 12/406,086

(22) Filed: Mar. 17, 2009

(65) Prior Publication Data

US 2009/0324408 A1 Dec. 31, 2009

(30) Foreign Application Priority Data

Jun. 26, 2008 (CN) ..... 2008 1 0302346

(51) Int. Cl.
*F04D 29/52* (2006.01)

(52) U.S. Cl. ..... 415/118; 416/5

(58) Field of Classification Search ..... 416/5; 415/118
See application file for complete search history.

(56) References Cited

U.S. PATENT DOCUMENTS 7,448,437 B2 11/2008 He
2007/0096570 A1* 5/2007 Lin et al. ..... 310/67 R

FOREIGN PATENT DOCUMENTS

CN 2307946 Y * 2/1999
CN 2763974 Y * 3/2006
CN 200999738 Y 1/2008

* cited by examiner

*Primary Examiner* — Richard Edgar
(74) *Attorney, Agent, or Firm* — Altis Law Group, Inc.

(57) ABSTRACT

A cooling fan includes a frame, a stator, a rotor and a display panel. The frame includes a base. The stator is mounted on a bottom surface of the base. The rotor is rotatably installed on the stator and received in the frame. The display panel is attached to a top surface of the base and electrically connected to the stator. The display panel can show a lot of useful information such as a logo of the cooling fan, a rotating speed of the cooling fan and an environment temperature.

15 Claims, 3 Drawing Sheets

COOLING FAN

BACKGROUND OF THE INVENTION

1. Field of the Invention

The present disclosure relates to cooling fans and, more particularly, to a cooling fan having a display panel mounted on a frame thereof to show dynamic information such as a rotating speed thereof.

2. Description of Related Art

With the continuing development of electronics technology, electronic components such as central processing units (CPUs), generate more and more heat that is required to be dissipated immediately. A heat sink is often mounted on an electronic component for absorbing heat therefrom, and a cooling fan is also provided to further remove heat from the heat sink by forced airflow.

A typical cooling fan has a frame and a rotor received in the frame. A label is generally attached to the frame to show a logo of the cooling fan. The label, usually made of paper or plastic, however, can only show logo and specifications of the cooling fan, which are static information. Static information is insufficient for someone who needs to know the dynamic information of the fan, for example, instant rotation speed of the fan.

What is needed, therefore, is an improved cooling fan which can show a lot of information thereof to satisfy users' increasing desires.

BRIEF DESCRIPTION OF THE DRAWINGS

Many aspects of the present apparatus can be better understood with reference to the following drawings. The components in the drawings are not necessarily drawn to scale, the emphasis instead being placed upon clearly illustrating the principles of the present apparatus. Moreover, in the drawings, like reference numerals designate corresponding parts throughout the several views.

DETAILED DESCRIPTION OF THE INVENTION

Figure 1:
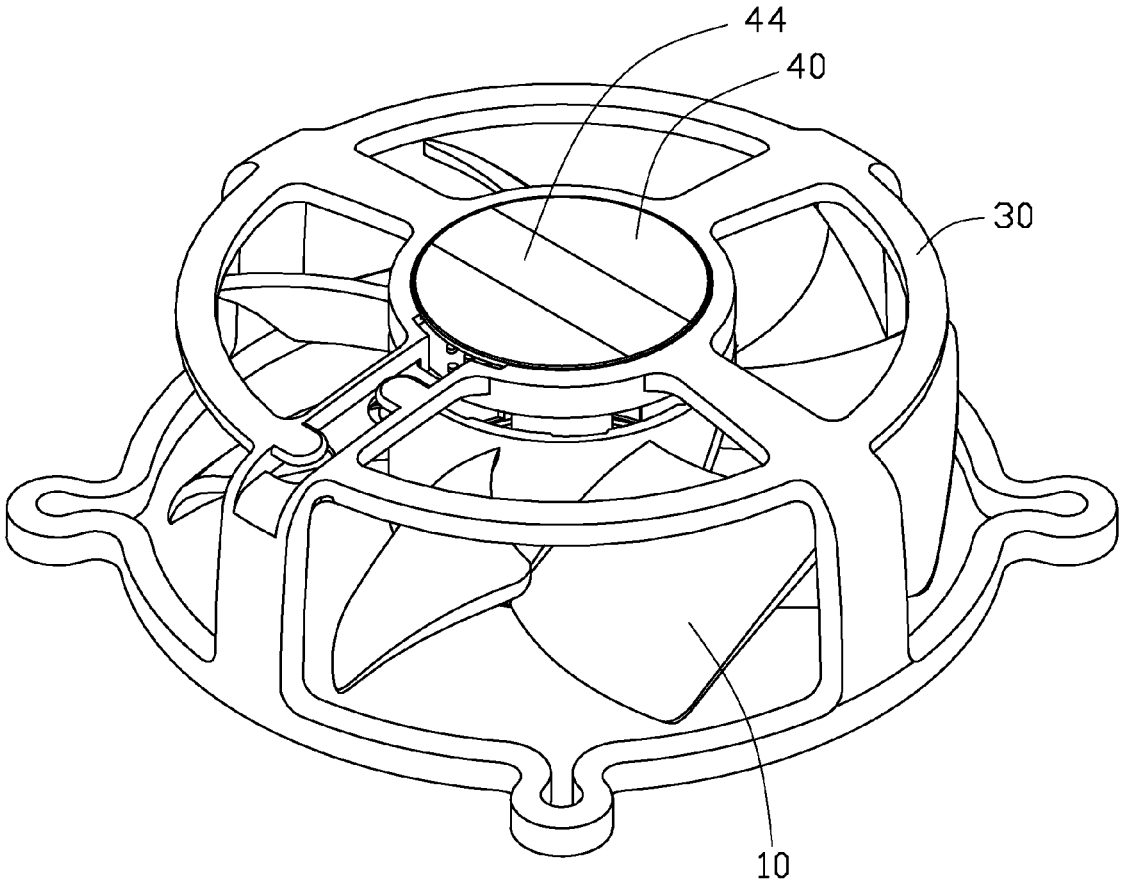
FIG. 1 is an assembled, isometric view of a cooling fan in accordance with an embodiment of the disclosure.
Figure 2:
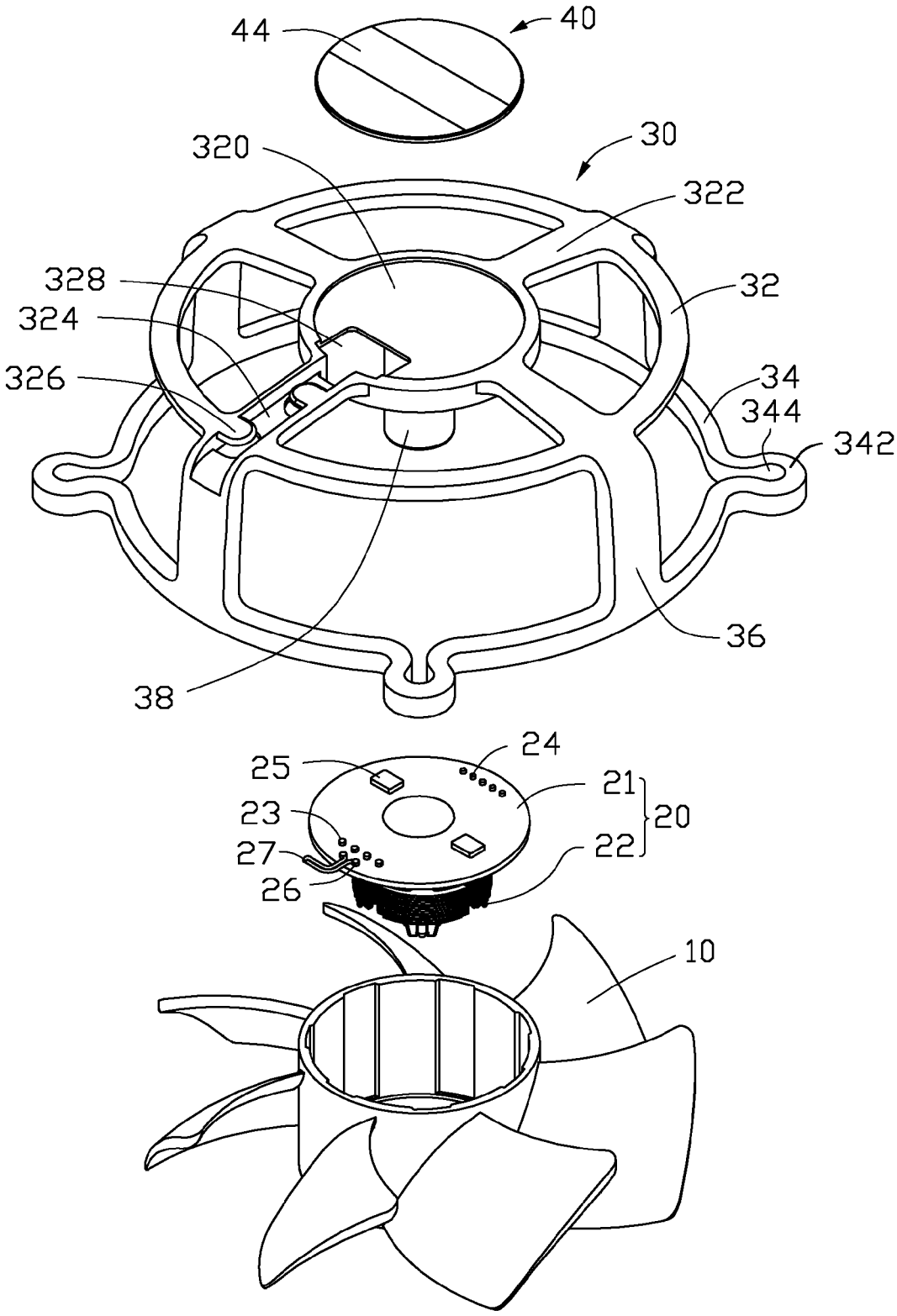
FIG. 2 is an exploded, isometric view of the cooling fan in FIG. 1.

Referring to FIGS. 1 and 2, a cooling fan in accordance with an embodiment of the disclosure used for cooling electronic components, such as CPUs, is shown. The cooling fan comprises a rotor 10, a stator 20, a frame 30 and a display panel 40. The stator 20 is mounted on the frame 30. The rotor 10 is rotatably installed on the stator 20, and received in the frame 30. The display panel 40 is attached to a top surface of the frame 30.

The stator 20 comprises a circular circuit board 21 and a stator core 22 consisting of layered yokes. The stator core 22 is located under a bottom surface of the circuit board 21. Stator coils (not labeled) coil on the stator core 22 to establish an alternating magnetic field. The circuit board 21 defines an opening (not labeled) at a center thereof. The circuit board 21 is electrically connected to the stator coils to control electrical current flowing through the stator coils. A plurality of connection terminals 23 and first solder terminals 24 are arranged on a top surface of the circuit board 21. The connection terminals 23 and the first solder terminals 24 are symmetrically positioned at two opposite sides of the opening of the circuit board 21. Two chips 25 are arranged at another two opposite sides of the opening of the circuit board 21. It is to be understood that, in alternative embodiments, positions and numbers of the connection terminals 23, the first solder terminals 24 and the chips 25 can be varied as desired. Two second solder terminals 26 are arranged on the top surface of the circuit board 21 and adjacent to the connection terminals 23. A temperature detector 27 is soldered to the two second solder terminals 26 for detecting an environment temperature. The temperature detector 27 extends out from the circuit board 21.

The frame 30 comprises a circular top plate 32, a circular bottom plate 34 parallel to the top plate 32, and a plurality of connecting plates 36 interconnecting the top and bottom plates 32, 34. A round base 320 is formed at a center of the top plate 32. A plurality of ribs 322 interconnect the top plate 32 and the base 320. A central tube 38 extends downwardly from a bottom surface of the base 320 for the rotor 10. The stator 20 is mounted on the central tube 38. A groove 324 is defined in one of the ribs 322 for power wires (not shown) of the cooling fan to extend therethrough. Two blocks 326 are formed on lateral sides of the rib 322 and are located above the groove 324 to prevent the power wires from escaping from the groove 324. An opening 328 is defined in the base 320 and communicates with the groove 324 of the rib 322. The power wires can extend through the opening 328 and connect the connection terminals 23 of the circuit board 21. A size of the bottom plate 34 is larger than that of the top plate 32. Four ears 342 are symmetrically formed on the bottom plate 34. A hole 344 is defined in each of the ears 342 for a fastener (not shown) to extend therethrough to secure the cooling fan.

Figure 3:
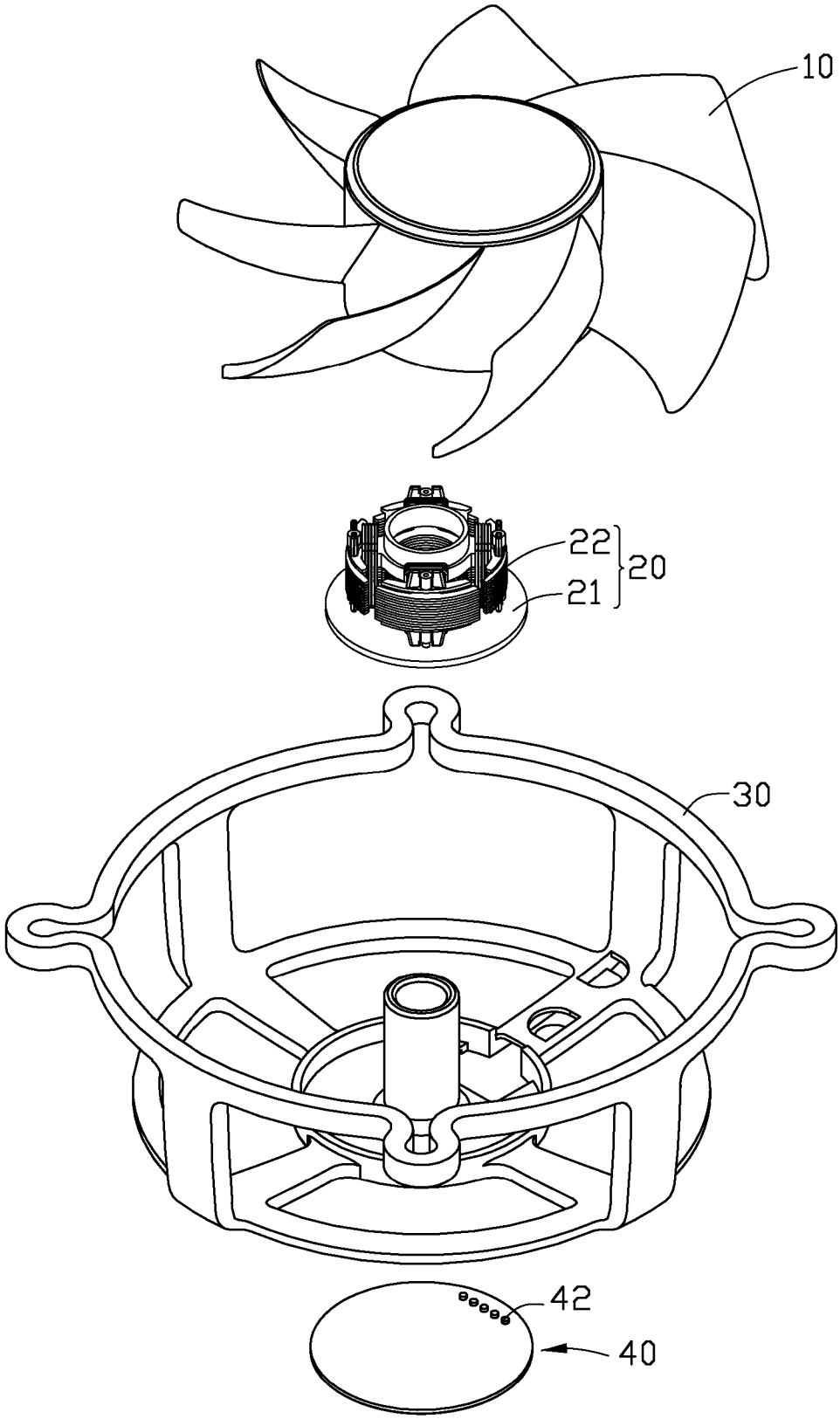
FIG. 3 is an inverted view of the cooling fan in FIG. 2.

Also referring to FIG. 3, the display panel 40 is a liquid crystal display panel in the present embodiment and comprises a rectangular display area 44. A plurality of third solder terminals 42 are arranged on a bottom surface of the display panel 40 and electrically connected to the first solder terminals 24 via a flexible printed circuit (FPC, not shown) for transmitting data. Understandably, a shape and size of the display area 44 can be changed in alternative embodiments. For example, the display area 44 can be a round shape expanded to the whole display panel 40. The display area 44 can dynamically demonstrate a lot of information such as a logo of the cooling fan, a rotating speed of the cooling fan, an environment temperature, or a temperature of CPUs, etc.

In assembly, the display panel 40 is attached to the top surface of the base 320 of the frame 30. The FPC is soldered to connect with the first solder terminals 24 of the circuit board 21 and the third solder terminals 42 of the display panel 40. The power wires are soldered to the connection terminals 23 of the circuit board 21 and extend through the opening 328 of the base 320 and the groove 324 of the frame 30. The stator 20 surrounds on the tube 38 of the frame 30. The rotor 10 is rotatably mounted on the stator 20.

In use, analog signals such as the rotating speed of the cooling fan and the environment temperature detected by the temperature detector 27 can be converted to digital signals by the chips 25 of the circuit board 21, and then displayed on the display panel 40. The information shown in the display panel 40 can be shown in slides, or can be shown at one time.

Compared to the conventional cooling fan, the cooling fan of the present disclosure can dynamically show a lot of useful information in real time by the display panel 40.

It is believed that the present disclosure and its advantages will be understood from the foregoing description, and it will be apparent that various changes may be made thereto without departing from the spirit and scope of the disclosure or sacrificing all of its material advantages, the examples hereinbefore described merely being preferred or exemplary embodiments of the disclosure.

What is claimed is:

1. A cooling fan for cooling electronic components, the cooling fan comprising:

a frame comprising a base;

a stator mounted on a bottom surface of the base;

a rotor rotatably installed on the stator and received in the frame; and a display panel attached to a top surface of the base and electrically connected to the stator, showing a rotating speed of the cooling fan, an environment temperature of the cooling fan, a temperature of the electronic components, and a logo of the cooling fan.

2. The cooling fan as claimed in claim 1, wherein the stator comprises a circuit board fixed on the bottom surface of the base and a stator core.

3. The cooling fan as claimed in claim 2, wherein the circuit board comprises a temperature detector formed thereon for detecting an environment temperature.

4. The cooling fan as claimed in claim 2, wherein the circuit board comprises two chips formed thereon for converting analog signals into digital signals to be displayed by the display panel.

5. The cooling fan as claimed in claim 3, wherein the circuit board further comprises a plurality of solder terminals electronically connected with a plurality of additional solder terminals formed on the display panel.

6. The cooling fan as claimed in claim 1, wherein the frame comprises a top plate, a bottom plate and a plurality of connecting plates interconnecting the top and bottom plates, the base being formed in a center of the top plate and connected to the top plate with a plurality of ribs.

7. The cooling fan as claimed in claim 6, wherein the base defines an opening therein, one of the ribs defines a groove therein and the groove is communicated with the opening of the base.

8. The cooling fan as claimed in claim 6, wherein the bottom plate has a size larger than the top plate, and forms a plurality of ears thereon for fasteners to extend therethrough to secure the cooling fan.

9. The cooling fan as claimed in claim 1, wherein the display panel is a liquid crystal display panel.

10. A cooling fan for cooling electronic components, the cooling fan comprising:

a frame comprising a bottom plate, a top plate, a plurality of connecting plates interconnecting the bottom and top plates, and a base formed at a center of the top plate;

a stator comprising a circuit board mounted on a bottom surface of the base and a stator core fixed to the circuit board;

a rotor rotatably installed on the stator and enclosed by the top, bottom and connecting plates of the frame; and a display panel attached to a top surface of the base and electronically connected to the stator for displaying a plurality of information in real time, wherein the information shown in the display panel comprises a rotating speed of the cooling fan, an environment temperature of the cooling fan, a temperature of the electronic components, and a logo of the cooling fan.

11. The cooling fan as claimed in claim 10, wherein the display panel is a liquid crystal display panel.

12. The cooling fan as claimed in claim 10, wherein the information is shown in slides.

13. The cooling fan as claimed in claim 10, wherein the frame further comprises a tube extending downwardly from the bottom surface of the base, the stator being installed on the tube.

14. The cooling fan as claimed in claim 10, wherein the circuit board comprises a plurality of first solder terminals formed thereon, the first solder terminals electrically connecting to a plurality of second solder terminals formed on the display panel.

15. The cooling fan as claimed in claim 10, wherein the circuit board comprises at least one chip formed thereon for converting analog signals into digital signals.

* * * * *